US005363990A

United States Patent [19]

Fillmore

[11] Patent Number: 5,363,990

[45] Date of Patent: Nov. 15, 1994

[54] DUAL CHAMBERED PUMP PACKAGE FOR VISCOUS PRODUCTS

[75] Inventor: William E. Fillmore, Toledo, Ohio

[73] Assignee: Owens-Illinois Closure Inc., Toledo, Ohio

[21] Appl. No.: 201,589

[22] Filed: Feb. 25, 1994

[51] Int. Cl.[5] ..... B67D 5/52

[52] U.S. Cl. ..... 222/135; 222/391

[58] Field of Search ..... 222/129, 135, 137, 391

[56] References Cited

U.S. PATENT DOCUMENTS

| | | | |
|---|---|---|---|
| 3,255,935 | 6/1966 | Spatz | 222/391 X |
| 3,750,913 | 8/1973 | Wild | 222/391 X |
| 4,323,176 | 4/1982 | Sartain | 222/391 X |
| 4,413,759 | 11/1983 | Mettenbrink . | |
| 4,421,255 | 12/1983 | Czech . | |
| 4,437,584 | 3/1984 | Connors et al. | 222/391 X |
| 4,437,591 | 3/1984 | von Schuckmann | 222/391 |
| 4,438,871 | 3/1984 | Eckert | 222/137 |
| 4,461,403 | 7/1984 | Prahs | 222/391 X |
| 4,487,341 | 12/1984 | Daykin et al. | 222/391 |
| 4,643,337 | 2/1987 | Heck et al. | 222/391 X |
| 4,673,106 | 6/1987 | Fishman | 222/391 X |
| 4,687,663 | 8/1987 | Schaeffer | 222/137 X |
| 4,691,847 | 9/1987 | Ford et al. | 222/259 |
| 4,749,106 | 6/1988 | von Schuckmann et al. | 222/391 X |
| 4,773,562 | 9/1988 | Gueret | 222/135 |
| 4,775,080 | 10/1988 | Mettenbrink | 222/391 |
| 4,826,044 | 5/1989 | Volfson | 222/391 X |
| 4,846,371 | 7/1989 | Pfanstiel | 222/135 |
| 4,949,874 | 8/1990 | Fiedler et al. | 222/135 |
| 5,209,376 | 5/1993 | Dirksing | 222/137 X |
| 5,224,627 | 7/1993 | Weag | 222/135 |
| 5,301,841 | 4/1994 | Fuchs | 222/135 |

FOREIGN PATENT DOCUMENTS

| | | | |
|---|---|---|---|
| 0284907 | 10/1988 | European Pat. Off. | 222/391 |
| 0420047 | 4/1991 | European Pat. Off. | 222/391 |
| 672904 | 1/1930 | France | 222/391 |

*Primary Examiner*—Kevin P. Shaver

[57] ABSTRACT

A dual chambered pump for viscous products having a plastic body having a top wall and a side wall. The top wall has spaced discharge openings. The body has spaced parallel cylinders. A piston is associated with each cylinder and a piston rod is associated with each piston. A one way spring is provided between each rod and its respective piston. Each rod extends through the top wall of the body. A plastic lever has a top portion and a side portion which includes integral means inter-engaging integral portions on the top wall for pivotally mounting the top portion of the lever on the top wall of the body such that the side portion of the lever extends along the side wall of the body. The top portion of the lever has integral portions engaging the integral portions on the rod. A spring on the side portion of the lever is engageable with the side wall of the body for urging the lever away from the body.

6 Claims, 2 Drawing Sheets

DUAL CHAMBERED PUMP PACKAGE FOR VISCOUS PRODUCTS

Field of the Invention

This invention relates to dual chambered pumps for viscous products, and particularly for dispensing viscous products which must be held separated until they are dispensed and used.

BACKGROUND OF THE INVENTION

Dual chamber pumps have been suggested in U.S. Pat. Nos. 3,255,935; 4,323,176; 4,413,759; 4,461,403; 4,487,341; 4,643,337; 4,673,106; 4,691,847; and 4,775,080.

Among the objectives of the present invention are to provide a dual chamber pump package for viscous products which efficiently dispenses viscous products from separate chambers; wherein by manual manipulation of a single lever balanced regulated amounts are dispensed from both chambers even when the chambers have differing diameters; wherein after dispensing when the lever is released, pistons in each chamber are held in a newly elevated position; wherein the pump package includes a minimum number of parts.

SUMMARY OF THE INVENTION

In accordance with the invention, the dual chambered pump package for viscous products comprising a plastic body having a top wall and a side wall. The top wall has spaced discharge openings. The body comprises spaced parallel cylinders and a piston is associated with each cylinder. A piston rod is associated with each piston. One way spring means is provided between each rod and its respective piston. Each rod extends through the top portion of a plastic lever having a top portion and a side portion. The top portion of the lever has interengaging integral means said top portion for pivotally mounting said top portion of the top wall of the body such that the side portion of the lever extends along the wall of said body. The top portion of said lever also has integral means engaging integral means on the rod. A spring means on the side portion of the lever is engageable with the side wall of the body for urging the lever away from the body.

DETAILED DESCRIPTION OF THE PREFERRED EMBODIMENT

Figure 2:
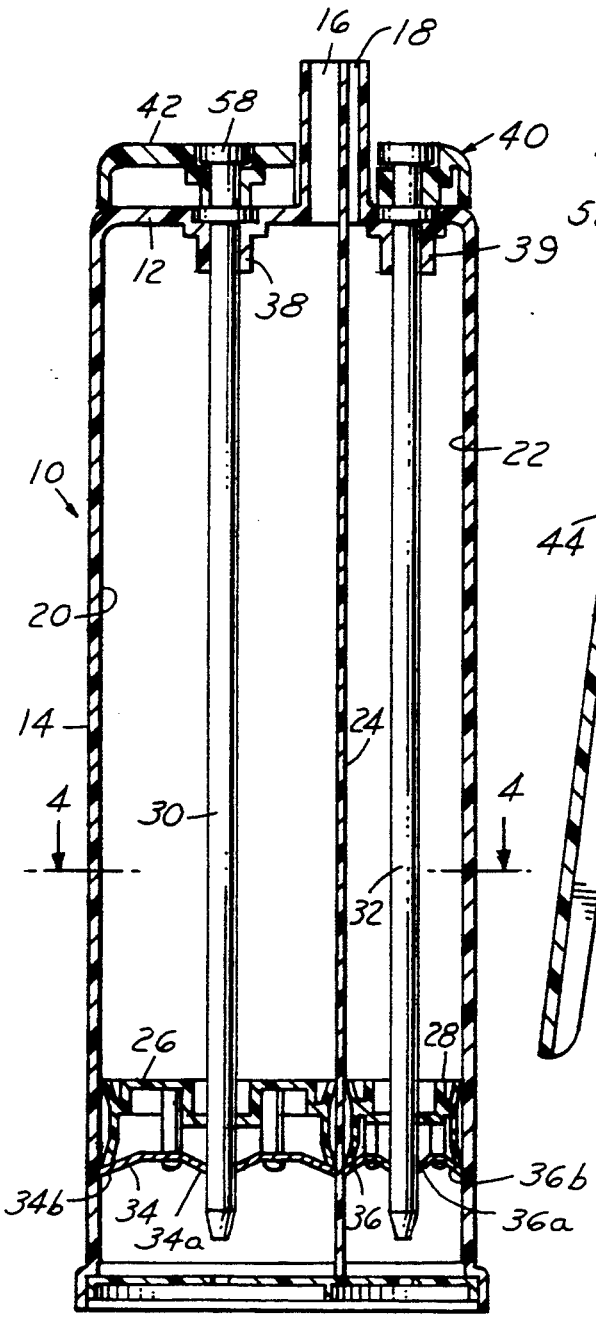
FIG. 2 is a sectional view takes along the line 2—2 in FIG. 1.
Figure 1:
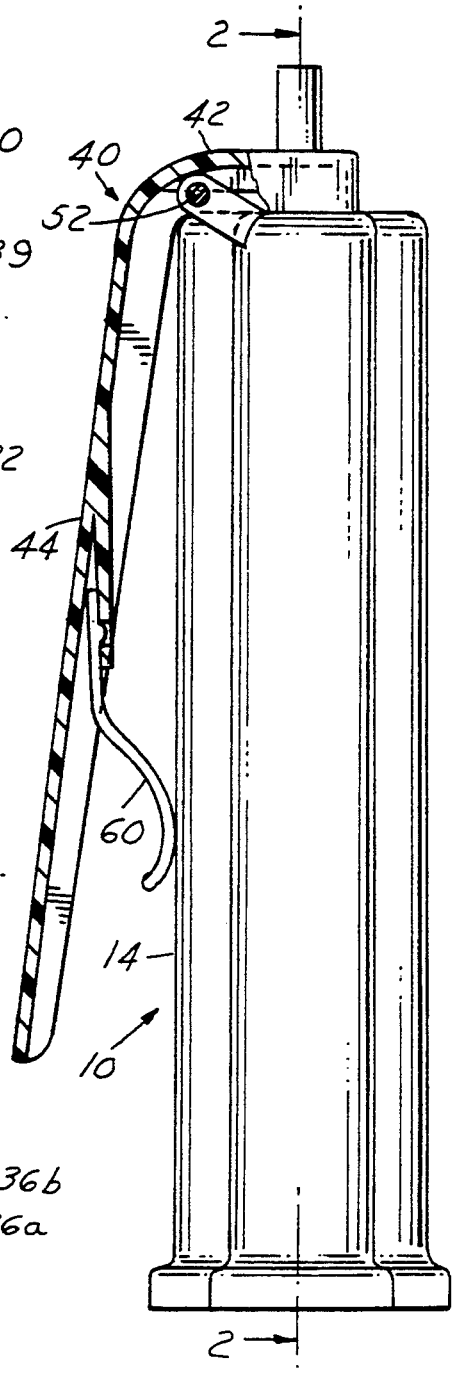
FIG. 1 is a side elevational view of a dual chamber pump package embodying the invention.
Figure 3:
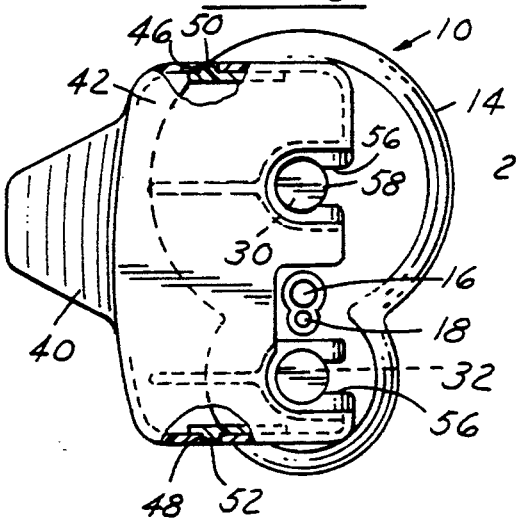
FIG. 3 is a top plan view.
Figure 5:
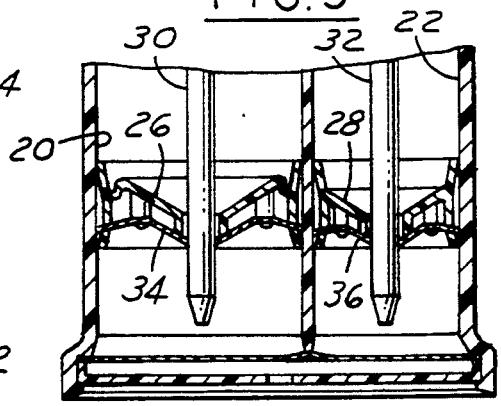
FIG. 5 is a fragmentary sectional view of a portion of the dual chamber pump package taken along the line 5—5 in FIG. 2.
Figure 4:
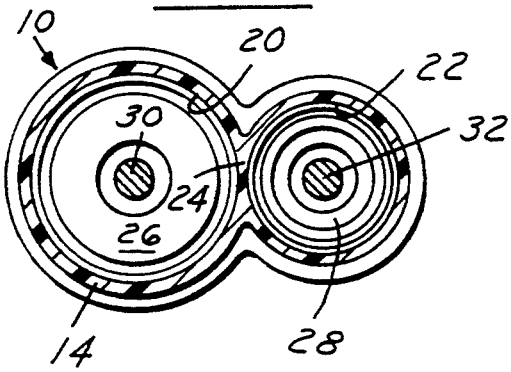
FIG. 4 is a sectional view taken along the line 4—4 in FIG. 2.
Figure 6:
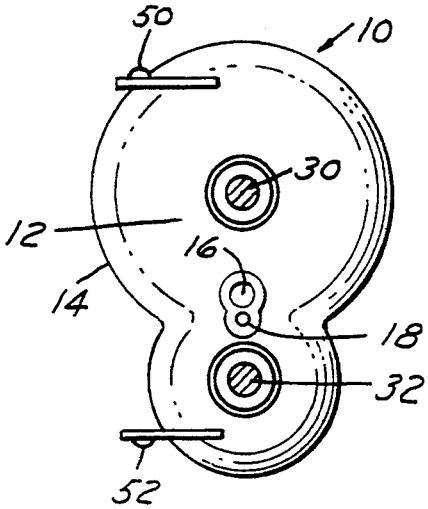
FIG. 6 is a top plan view parts being broken away.

Referring to FIGS. 1 and 2, the dual chamber pump package embodying the invention comprises a plastic body 10 having a top wall 12 and a side wall 14. The top wall 12 has spaced discharge openings 16, 18. The body 10 defined by an integral wall 24 comprises spaced parallel cylinders 20, 22. A piston 26, 28 is associated with each cylinder 20, 22, respectively. A piston rod 30, 32 is associated with each piston 26, 28. One way spring means 34, 36 is provided between each rod 30, 32 and its respective piston 26, 28 respectively. Each rod 30, 32 extends through integral sealing bushings 38, 39 in the top wall 12.

A plastic lever 40 is provided and has a top portion 42 and a side portion 44. The top portion 42 of the lever 40 has interengaging recesses 46, 48 that engage integral pins 50, 52 on the top wall 12 of the body 10 for pivotally mounting the top portion 42 of the lever 40 on the top wall 12 of the body 10 such that the side portion 44 of the lever 40 extends along the wall 14 of body 10. The top portion 42 of lever 40 also has integral slots 56 that extend between engaging integral flanges 58 on the rod. A spring 60 on the side portion 44 of lever 40 is engageable with the side wall 14 of the body 10 for urging the side portion 44 of lever 40 away from the body 10.

The two cylinders 20, 22 of unequal diameters accommodate and dispense viscous products in regulated amounts. This is especially useful where the products react when placed together and consequently they must remain separated until exiting the two discharge tubes 16, 18 which are integral with the top wall 12 of the body 10.

The lever system 40 consisting of a long vertical lever 44 and a lever spring 60 is thus fulcrumed to the upper section of the body 10 and is connected to two rods 30, 32 which actuate the two pistons 26, 28 within their respective cylinders 20, 22. The lever 40 and lever spring 60 can be molded as one piece.

The two spring clips 34, 36, affixed to the pistons 26, 28 grip the rods 30, 32 firmly to lift the pistons 26, 28 as the rods 30, 32 are raised. The outer fingers **34*a*, 36*a* of the spring clips 34, 36 release their grip on the cylinder walls 20, 22 as the pistons 30, 32 rise. When the lever 40 is released, the lever spring 60 returns the lever 40 to normal extended position. The rods 30, 32 are lowered during this action distending the inner fingers 34*b*, 36*b* of the spring clips 34, 36. These inner fingers 34*b*, 36*b* regrip the rods 30, 32 at a higher level as the rods 30, 32** come to rest in their lowered position.

A bottom cover 62 maintains package integrity and admits air into the spaces below the pistons 26, 28 to replace the volume of the products dispensed.

The cylinders within the body, the pistons and the spring clip can be of equal size, depending upon the ratio of products dispensed.

I claim:

1. A dual chambered pump for viscous products comprising a plastic body having a top wall and a side wall,
said top wall having spaced discharge openings,
said body comprising spaced parallel cylinders,
a piston associated with each cylinder,
a piston rod associated with each piston,
one way spring means between each said rod and its respective piston,
each said rod extending through the top wall of said body,
a plastic lever having a top portion and a side portion,
said top portion of said lever having integral means interengaging integral means on said top wall for pivotally mounting said top portion of said lever on said top wall of said body such that the side portion of said lever extends along the side wall of said body, said top portion of said lever having integral means engaging integral means on said rod, and spring means on said side portion of said lever engageable with the side wall of said body for urging said lever away from said body.

2. The dual chambered pump set forth in claim 1 wherein said spring means on said lever comprises an integral spring member on said lever extending axially along said side wall of said body.

3. The dual chambered pump set forth in claim 1 wherein said integral means on said top portion of said lever comprises spaced slots, said integral means on each said rod comprising spaced flanges extending above and below said slots.

4. The method of making a dual chambered pump for viscous products comprising forming a plastic body having a top wall and a side wall, said top wall having spaced discharge openings, said body comprising spaced parallel cylinders, providing a piston associated with each cylinder, providing a piston rod associated with each piston, providing one way spring means between each said rod and its respective piston, positioning each said rod such that it extends through the top wall of said body, providing a plastic lever having a top portion and a side portion, said top portion of said lever having integral means for interengaging integral means on said top wall, engaging the integral means on said lever with the integral means on said top wall for pivotally mounting said top portion of said lever on said top wall of said body such that the side portion of said lever extends along the side wall of said body, said top portion of said lever having integral means engaging integral means on said rod, and providing spring means on said side portion of said lever engageable with the side wall of said body for urging said lever away from said body.

5. The method of forming a dual chambered pump set forth in claim 4 wherein said spring means on said lever comprises an integral spring member on said lever extending axially along said side wall of said body.

6. The method of forming the dual chambered pump set forth in claim 4 including forming said integral means on said top portion of said lever with spaced slots, forming said integral means on each said rod with spaced flanges, and engaging said flange between said slots extending above and below said slots.

* * * * *